US010795282B2

(12) United States Patent
Sunayama et al.

(10) Patent No.: US 10,795,282 B2
(45) Date of Patent: Oct. 6, 2020

(54) IMAGE FORMING APPARATUS

(71) Applicant: KYOCERA Document Solutions Inc., Osaka (JP)

(72) Inventors: Satoshi Sunayama, Osaka (JP); Shizuya Uemura, Osaka (JP); Takashi Inoue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/745,027

(22) Filed: Jan. 16, 2020

(65) Prior Publication Data

US 2020/0233333 A1 Jul. 23, 2020

(30) Foreign Application Priority Data

Jan. 17, 2019 (JP) ..... 2019-006078

(51) Int. Cl.
*G03G 15/06* (2006.01)

(52) U.S. Cl.
CPC ..... *G03G 15/065* (2013.01)

(58) Field of Classification Search
CPC ..... G03G 15/065
See application file for complete search history.

(56) References Cited

U.S. PATENT DOCUMENTS 6,058,275 A * 5/2000 Kodama ..... G03G 15/065 399/46
2005/0158064 A1* 7/2005 Yoshida ..... G03G 15/06 399/49
2007/0071473 A1* 3/2007 Haraguchi ..... G03G 15/0813 399/53

FOREIGN PATENT DOCUMENTS

JP 2005189790 A 7/2005

* cited by examiner

*Primary Examiner* — Carla J Therrien
(74) *Attorney, Agent, or Firm* — Studebaker & Brackett PC

(57) ABSTRACT

An image forming apparatus includes a photosensitive drum, a developing section, a voltage applicator, a detector, a calculating section, and an evaluating section. The detector detects values of first and second currents. The first current flows between the photosensitive drum and the developing section during formation of an electrostatic latent image. The second current flows between the photosensitive drum and the developing section when the electrostatic latent image is not being formed. The calculating section calculates a toner charge-to-mass ratio. The evaluating section evaluates reliability of a calculation result of the toner charge-to-mass ratio by comparing the second current value to a reference value. The reference value is of a reference current flowing between the photosensitive drum and the developing section when the electrostatic latent image is not being formed, and indicates a current value detected after adjustment to at least one of the photosensitive drum and the developing section.

6 Claims, 10 Drawing Sheets

IMAGE FORMING APPARATUS

INCORPORATION BY REFERENCE

The present application claims priority under 35 U.S.C. § 119 to Japanese Patent Application No. 2019-006078, filed on Jan. 17, 2019. The contents of this application are incorporated herein by reference in their entirety.

BACKGROUND

The present disclosure relates to an image forming apparatus.

A known image forming apparatus includes a development power supply and a photosensor. The development power supply applies a development bias to a development roller. The development power supply also detects a development electric current when an electrostatic latent image formed on a photosensitive drum is developed to form a toner image. The photosensor detects a toner attachment amount of the toner image formed on the photosensitive drum. In the image forming apparatus, the electric current value of the development electric current detected by the development power supply is a charge amount of toner moved to the photosensitive drum from the development roller. A charge-to-mass ratio of the toner is calculated from the toner charge amount and the toner attachment amount.

SUMMARY

An image forming apparatus according to an aspect of the present disclosure includes a photosensitive drum, a developing section, a voltage applicator, a detector, a calculating section, and an evaluating section. The developing section develops an electrostatic latent image formed on the photosensitive drum with toner to form a toner image on the photosensitive drum. The voltage applicator applies a development bias to the developing section. The detector detects an electric current value of a first electric current and an electric current value of a second electric current. The first electric current flows between the photosensitive drum and the developing section when the electrostatic latent image is being formed. The second electric current flows between the photosensitive drum and the developing section when the electrostatic latent image is not being formed. The calculating section calculates a charge-to-mass ratio of the toner based on an amount of the toner forming the toner image and the electric current value of the first electric current. The evaluating section evaluates reliability of a calculation result of the charge-to-mass ratio of the toner based on a result of comparison between the electric current value of the second electric current and a reference value. The reference value is an electric current value of a reference electric current flowing between the photosensitive drum and the developing section when the electrostatic latent image is not being formed, and indicates the electric current value detected by the detector after adjustment to at least one of the photosensitive drum and the developing section.

DETAILED DESCRIPTION

Figure 1:
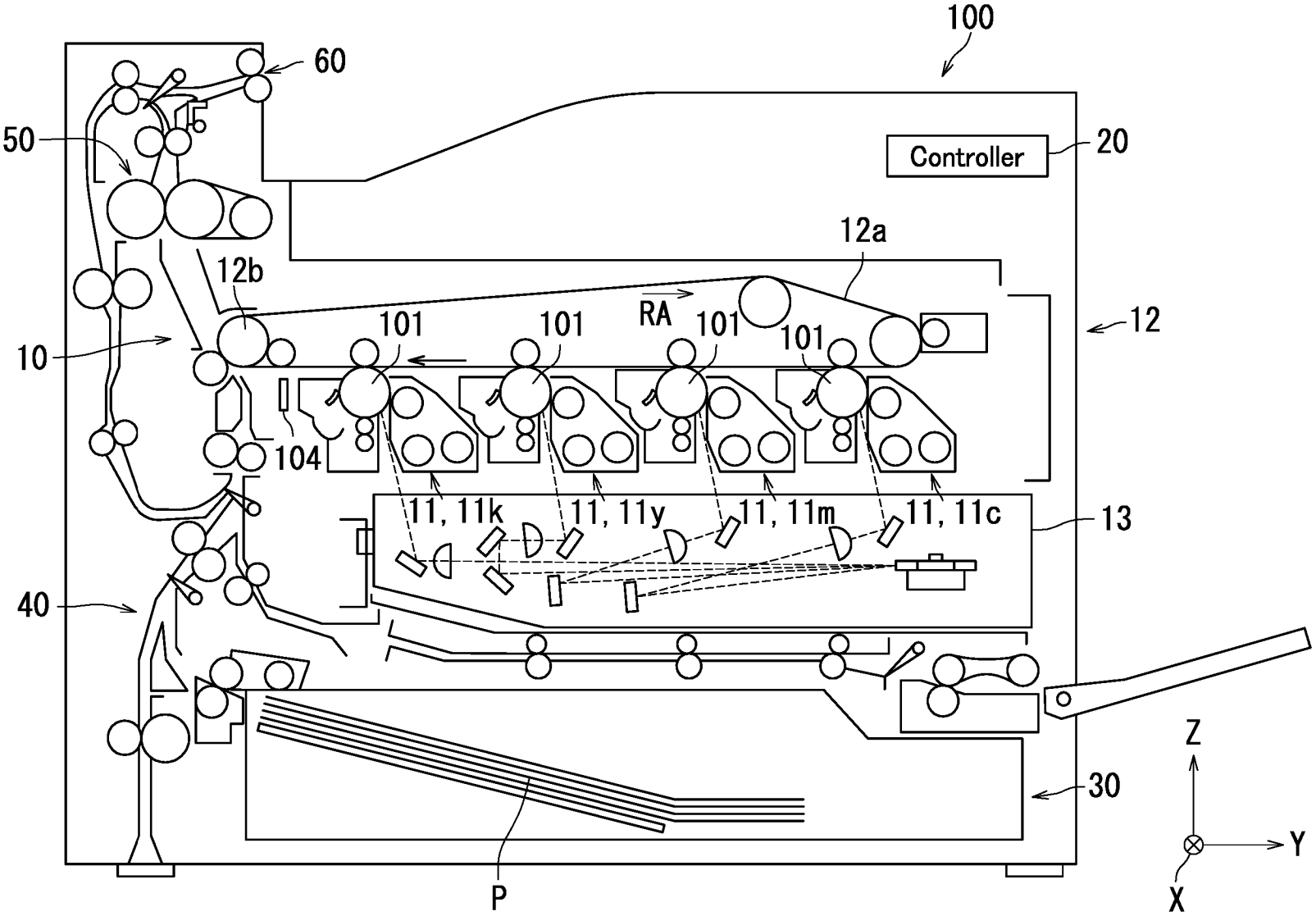
FIG. 1 is a diagram illustrating a configuration of an image forming apparatus according to a first embodiment of the present disclosure.

The following describes embodiments of the present disclosure with reference to the drawings. Elements that are the same or equivalent are labeled with the same reference signs in the drawings and description thereof is not repeated. In the embodiments, X and Y axes are parallel to a horizontal plane, and a Z axis is parallel to a vertical direction. The X, Y, and Z axes are orthogonal to each other.

First Embodiment

First, a configuration of an image forming apparatus 100 according to a first embodiment is described with reference to FIG. 1. FIG. 1 is a diagram illustrating the configuration of the image forming apparatus 100. The image forming apparatus 100 is a color multifunction peripheral, for example.

As illustrated in FIG. 1, the image forming apparatus 100 includes an image forming unit 10, a feeding section 30, a conveyance section 40, a fixing section 50, an ejection section 60, a controller 20, and a density sensor 104. The density sensor 104 is described later.

The feeding section 30 feeds a sheet P to the conveyance section 40. The conveyance section 40 conveys the sheet P to the ejection section 60 by way of the image forming unit 10 and the fixing section 50. The image forming unit 10 forms an image on the sheet P. The fixing section 50 applies heat and pressure to the sheet P, thus fixing the image formed on the sheet P to the sheet P. The ejection section 60 ejects the sheet P out of the image forming apparatus 100. The controller 20 controls the image forming unit 10, the feeding section 30, the conveyance section 40, the fixing section 50, and the ejection section 60.

Next, a configuration of the image forming unit 10 is described. The image forming unit 10 includes a plurality of image forming sections 11, an exposure section 13, and a transfer section 12.

Toners of mutually different colors are supplied to the respective image forming sections 11. The toners include a large number of toner particles. The image forming sections 11 each include a photosensitive drum 101. For example, the image forming sections 11 include an image forming section 11*c* to which a cyan toner is supplied, an image forming section 11*m* to which a magenta toner is supplied, an image forming section 11*y* to which a yellow toner is supplied, and an image forming section 11*k* to which a black toner is supplied. The image forming sections 11*c*, 11*m*, 11*y*, and 11*k* have substantially identical configurations.

The exposure section 13 exposes the respective photosensitive drums 101 with light based on image data. As a result, an electrostatic latent image is formed on each of the photosensitive drums 101. The image forming sections 11 then develop the respective electrostatic latent images formed on the photosensitive drums 101 to form toner images on the photosensitive drums 101. As a result, toner images of mutually different colors are formed on the respective photosensitive drums 101.

The transfer section 12 includes an intermediate transfer belt 12*a* and a drive roller 12*b*. The intermediate transfer belt 12*a* is driven to rotate in a rotational direction RA by the drive roller 12*b*. The image forming sections 11 transfer the toner images of the mutually different colors on to the intermediate transfer belt 12*a*. The toner images of the mutually different colors are superimposed on the intermediate transfer belt 12*a*, thus forming a toner image (a color image, specifically) on the intermediate transfer belt 12*a*. The transfer section 12 transfers the toner image formed on the intermediate transfer belt 12*a* onto the sheet P. As a result, an image is formed on the sheet P.

The density sensor 104 detects the density of the toner image formed on the intermediate transfer belt 12*a*. The density of the toner image indicates the mass of the toner forming the toner image per unit of surface area. Therefore, the density of the toner image can be calculated based on the thickness of the toner image if the surface area of the toner image is known. In the first embodiment, the density sensor 104 detects a toner image thickness HT. In detail, the density sensor 104 measures a distance LT between the density sensor 104 and the toner image to detect the image thickness HT. In further detail, the density sensor 104 detects the image thickness HT using the following formula (1).

$$(\text{Thickness } HT) = (\text{Reference distance } LTA) - (\text{Distance } LT) \quad (1)$$

It should be noted that the reference distance LTA is the distance between the density sensor 104 and the outer surface of the intermediate transfer belt 12*a*.

The density sensor 104 is a laser displacement sensor, for example. The laser displacement sensor includes a semiconductor laser and a linear image sensor, and measures the distance LT using triangulation. The density sensor 104 outputs a signal SG1 indicating the density of the toner image to the controller 20.

Figure 2:
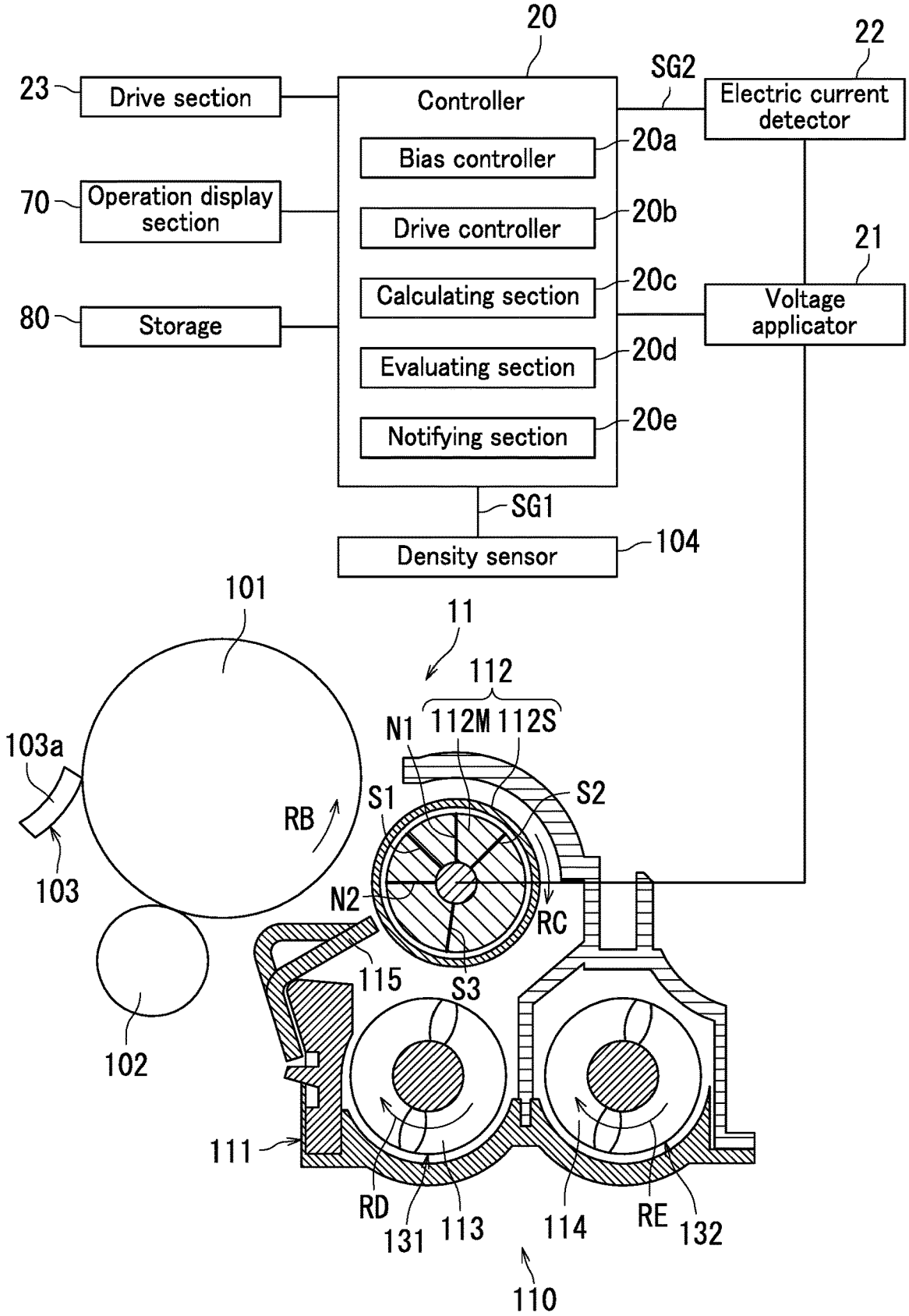
FIG. 2 is a cross-sectional view of an example of a configuration of an image forming section according to the first embodiment.

Next, a configuration of an image forming section 11 according to the first embodiment is described with reference to FIGS. 1 and 2. FIG. 2 is a cross-sectional view of an example of the configuration of the image forming section 11.

As illustrated in FIG. 2, the image forming section 11 further includes a developing section 110, a charger 102, and a cleaning section 103 in addition to the photosensitive drum 101. The photosensitive drum 101 has a substantially columnar or cylindrical shape. The photosensitive drum 101 rotates in a rotational direction RB around a rotational axis AX of the photosensitive drum 101. Examples of the photosensitive drum 101 include an amorphous silicon (α-Si) photosensitive drum and an organic photoconductor (OPC) drum.

The charger 102 charges the surface of the photosensitive drum 101 to a prescribed potential. The charger 102 includes a charging roller, for example. As illustrated in FIGS. 1 and 2, the exposure section 13 exposes the surface of the photosensitive drum 101 based on image data. As a result, an electrostatic latent image is formed on the surface of the photosensitive drum 101. The developing section 110 also develops the electrostatic latent image formed on the surface of the photosensitive drum 101 with toner, thereby forming a toner image on the surface of the photosensitive drum 101.

The cleaning section 103 cleans the surface of the photosensitive drum 101. Specifically, the cleaning section 103 includes a cleaning blade 103*a*. The cleaning blade 103*a* wipes the surface of the photosensitive drum 101. By wiping the surface of the photosensitive drum 101 with an edge of the cleaning blade 103*a*, remaining toner is removed from the surface of the photosensitive drum 101.

Figure 3:
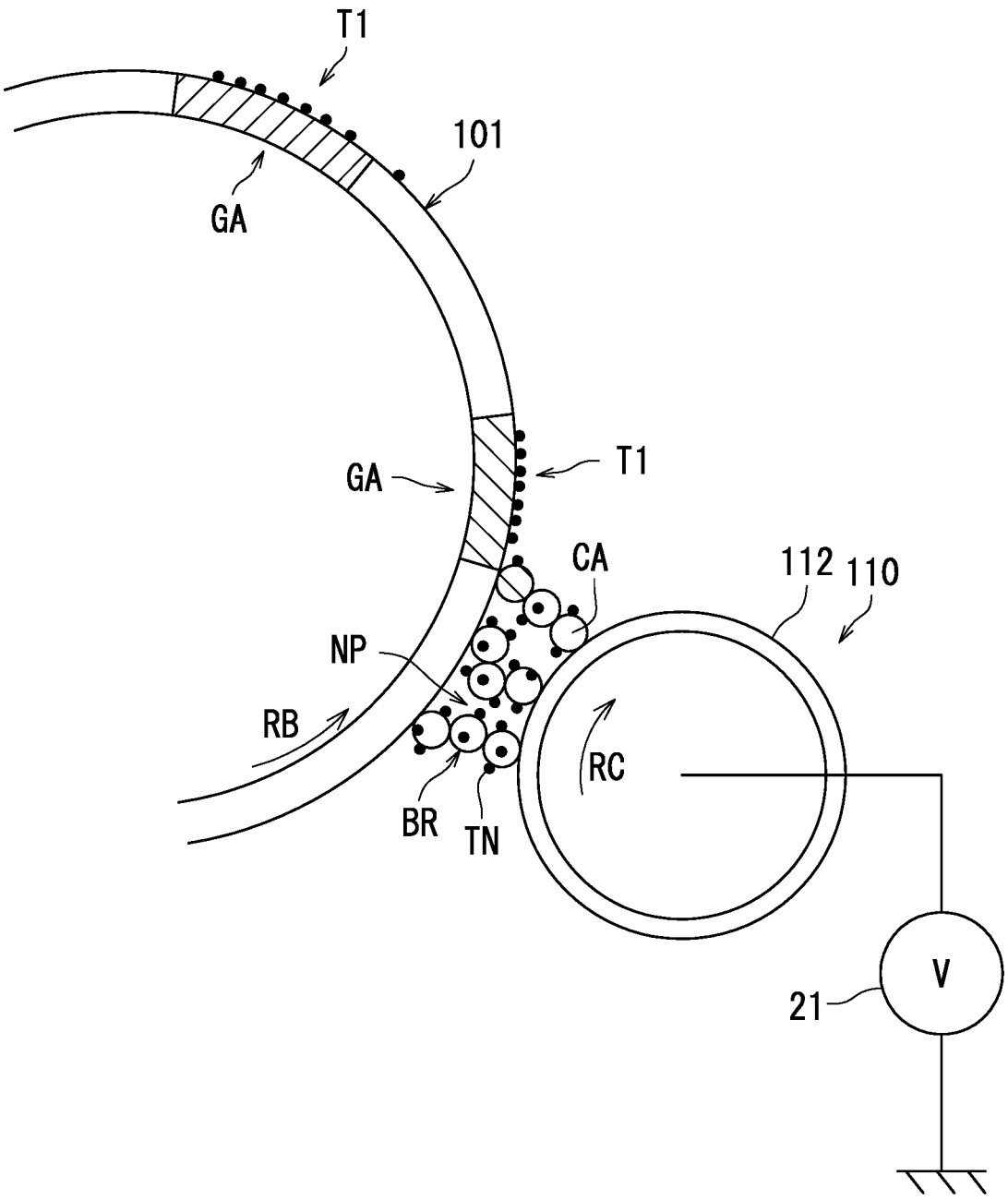
FIG. 3 is a diagram illustrating development operation of the image forming section according to the first embodiment.

Next, the developing section 110 is described with reference to FIGS. 2 and 3. FIG. 3 is a diagram illustrating development operation of the image forming section 11. It should be noted that in FIG. 3, black dots indicate toner particles TN and white circles indicate carrier particles CA.

As illustrated in FIG. 3, the developing section 110 forms a toner image TI on the photosensitive drum 101 by developing an electrostatic latent image GA formed on the photosensitive drum 101 with a plurality of toner particles TN. The toner particles TN are included in a two-component developer. The two-component developer is housed in the developing section 110.

Specifically, the two-component developer includes a plurality of carrier particles CA (a large number of carrier particles CA, specifically) in addition to the toner particles TN (a large number of toner particles TN, specifically). The toner particles TN and the carrier particles CA are powder. The toner particles TN are positively chargeable toner particles, for example. The toner particles TN are positively charged by friction with the carrier particles CA.

The particle diameter of the toner particles TN is between 5.0 μm and 8.0 μm in terms of volume reference median diameter ($D_{50}$), for example, favorably between 5.2 μm and 6.7 μm.

The carrier particles CA are magnetic. The carrier particles CA are resin-coated carrier particles, for example. Core particles of the resin-coated carrier particles CA are made from ferrite or magnetite, for example. The particle diameter of the carrier particles CA is between 20 μm and 100 μm in terms of volume average particle diameter, for example, favorably between 25 μm and 80 μm.

Here, a development nip part NP is formed between the development roller 112 and the photosensitive drum 101. When a development bias is applied to the development roller 112, an electric field is formed in the development nip part NP. Accordingly, the toner particles TN are detached from a magnetic brush BR and moved to the photosensitive drum 101 due to the effect of the electric field. As a result, the electrostatic latent image GA is developed with the toner particles TN and the toner image TI is formed. The toner image TI is transferred to the intermediate transfer belt 12*a* illustrated in FIG. 1.

As illustrated in FIG. 2, the developing section 110 includes a development housing 111, the development roller 112, a first screw feeder 113, a second screw feeder 114, and a regulation blade 115. The development roller 112 is equivalent to an example of a "developer bearing member".

The development roller 112 is located opposite to the photosensitive drum 101. The development roller 112 includes a sleeve 112S and a magnet 112M. The magnet 112M is located inside the sleeve 112S. The magnet 112M includes an S1 pole, an N1 pole, an S2 pole, an N2 pole, and an S3 pole. The N1 pole functions as a main pole, the S1 pole and the N2 pole function as conveyance poles, and the S2 pole functions as a detachment pole. The S3 pole functions as a drawing pole and a regulation pole. For example, the magnetic flux densities of the S1 pole, the N1 pole, the S2 pole, the N2 pole, and the S3 pole are respectively 54 mT, 96 mT, 35 mT, 44 mT, and 45 mT.

The sleeve 112S is a non-magnetic cylinder (an aluminum pipe, for example). The sleeve 112S is driven by a motor, for example, and rotates in a rotational direction RC around the magnet 112M.

Accordingly, as illustrated in FIG. 3, the sleeve 112S draws the carrier particles CA through the magnetic force of the magnet 112M while rotating in the rotational direction RC. As a result, the magnetic brush BR is formed on the surface of the development roller 112 by the carrier particles CA. Specifically, a plurality of magnetic brushes BR is formed on the surface of the development roller 112. Each of the magnetic brushes BR is made from a plurality of carrier particles CA. That is, each of the magnetic brushes BR is a carrier particle cluster standing from the surface of the development roller 112. The toner particles TN are carried on the surfaces of the carrier particles CA. That is, the toner particles TN are carried on the surface of the development roller 112 while being carried by the magnetic brushes BR.

As illustrated in FIG. 2, the regulation blade 115 is located opposite to the development roller 112 with a prescribed space therebetween. The regulation blade 115 regulates the length of the magnetic brushes BR formed on the surface of the development roller 112.

The development housing 111 houses the two-component developer. The development housing 111 also includes a first conveyance section 131 and a second conveyance section 132. In the first conveyance section 131, the two-component developer is conveyed in a first conveyance direction which is from one end to the other end of the development roller 112 in an axial direction thereof. The second conveyance section 132 communicates with the first conveyance section 131 at either end of the development roller 112 in the axial direction thereof. The second conveyance section 132 conveys the two-component developer in a second conveyance direction which is opposite to the first conveyance direction.

Specifically, the second conveyance section 132 includes the second screw feeder 114. The second screw feeder 114 conveys the two-component developer in the second conveyance direction by rotating in a rotational direction RE. The first conveyance section 131 includes the first screw feeder 113. The first screw feeder 113 conveys the two-component developer in the first conveyance direction by rotating in a rotational direction RD. The first screw feeder 113 supplies the two-component developer to the development roller 112 while conveying the two-component developer in the first conveyance direction.

The toner particles TN included in the two-component developer are triboelectrically charged between the carrier particles CA included in the two-component developer while being circularly conveyed in the first and second conveyance directions.

Continuing, the image forming apparatus 100 is described in detail with reference to FIG. 2. As illustrated in FIG. 2, the image forming apparatus 100 further includes a voltage applicator 21, a drive section 23, and an operation display section 70.

As illustrated in FIG. 2, the voltage applicator 21 applies a development bias to the development roller 112. The development bias is a voltage in which an alternating current voltage is superimposed on a direct current voltage. The alternating current voltage has a square wave with a duty cycle of 50%, for example. Specifically, the voltage applicator 21 includes a direct current power supply and an alternating current power supply.

The drive section 23 rotationally drives the photosensitive drum 101, the development roller 112, the first screw feeder 113, and the second screw feeder 114. The drive section 23 includes a motor and a gear mechanism, for example.

The operation display section 70 includes a touch panel. The touch panel includes a display such as a liquid-crystal display (LCD), and displays various images. The touch panel further includes a touch sensor and detects touch operation of a user.

Figure 4:
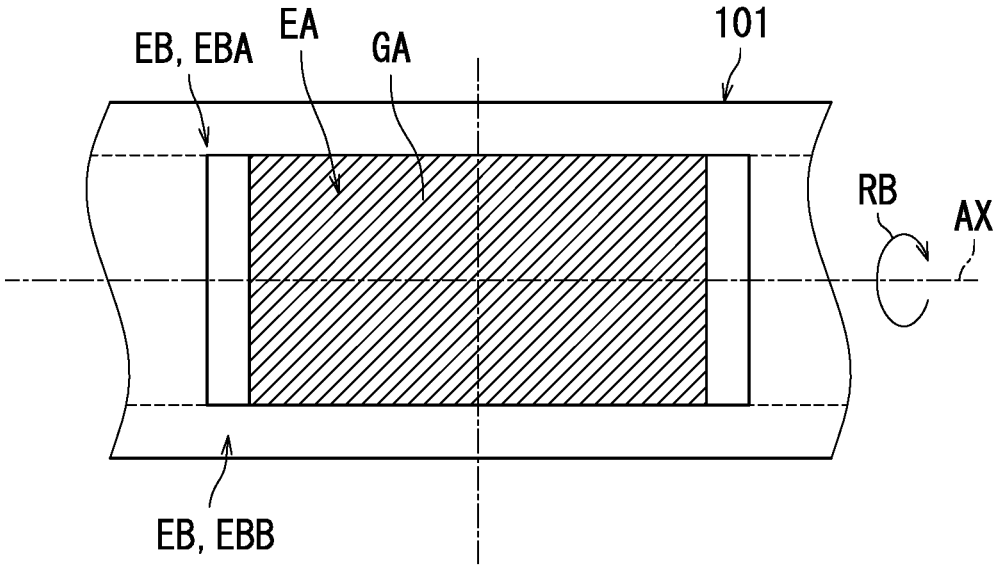
FIG. 4 is a plan view of an example of a configuration of a photosensitive drum according to the first embodiment.

Next, a configuration of the photosensitive drum 101 is described with reference to FIG. 4. FIG. 4 is a plan view of an example of the configuration of the photosensitive drum 101. In FIG. 4, the photosensitive drum 101 is viewed from a direction orthogonal to the rotational axis AX of the photosensitive drum 101. In the following, the view of the photosensitive drum 101 from the direction orthogonal to the rotational axis AX may be referred to as a "plan view".

As illustrated in FIG. 4, the surface of the photosensitive drum 101 has a first area EA and a plurality of second areas EB. The second areas EB include a second area EBA and a second area EBB. The first area EA is an area in which a toner image is finally transferred to the sheet P. The second areas EB are areas in which a toner image is not finally transferred to the sheet P. That is, the second areas EB each indicate a blank portion.

The second area EBA is positioned, in the circumferential direction of the photosensitive drum 101, upstream of the first area EA in the rotational direction RB of the photosensitive drum 101. The second area EBB is positioned, in the circumferential direction of the photosensitive drum 101, downstream of the first area EA in the rotational direction RB of the photosensitive drum 101.

The charger 102 illustrated in FIG. 2 charges the surface of the photosensitive drum 101 to a prescribed potential. Accordingly, the first area EA and the second areas EB of the photosensitive drum 101 are charged to a prescribed potential.

The exposure section 13 illustrated in FIG. 1 exposes the surface of the photosensitive drum 101. The exposure section 13 radiates laser light to the first area EA to expose the first area EA, thus forming the electrostatic latent image GA in the first area EA. The exposure section 13 includes a light source, a polygon mirror, a reflecting mirror, and a deflecting mirror, for example.

Figure 5:
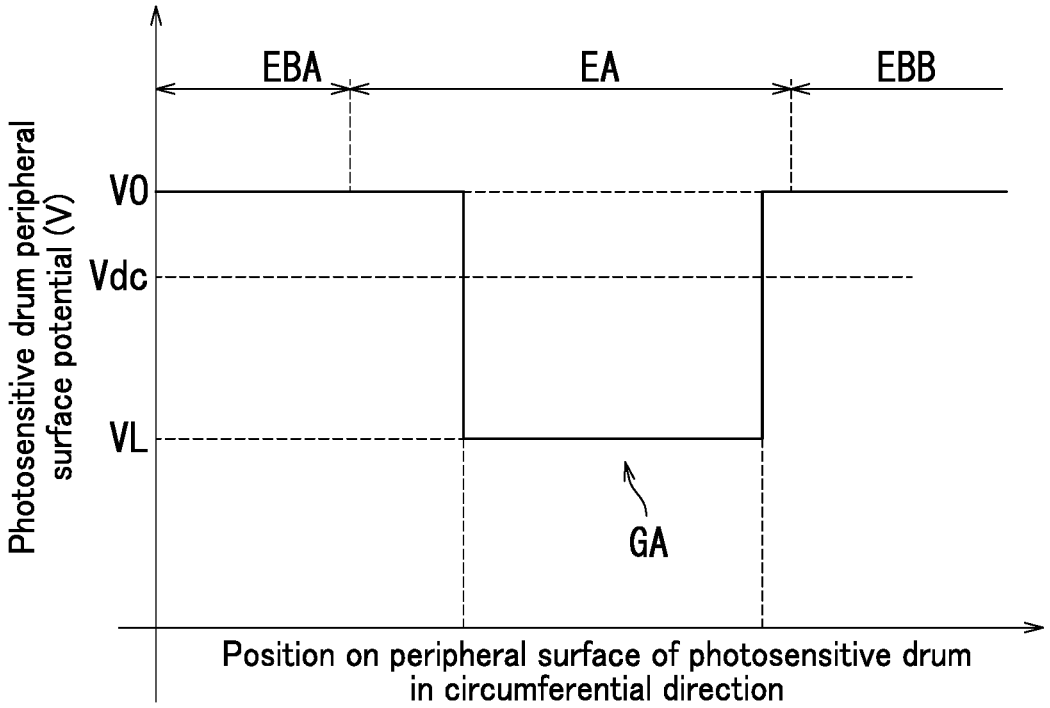
FIG. 5 is a graph illustrating the potential of the photosensitive drum and the potential of a development roller according to the first embodiment.

Next, the potential of the photosensitive drum 101 and the potential of the development roller 112 are described with reference to FIG. 5. FIG. 5 is a graph illustrating the potential of the photosensitive drum 101 and the potential of the development roller 112. In FIG. 5, the vertical axis indicates the potential of the peripheral surface of the photosensitive drum 101, and the horizontal axis indicates a position on the peripheral surface of the photosensitive drum 101 in the circumferential direction thereof.

As illustrated in FIG. 5, the first area EA and the second areas EB of the photosensitive drum 101 are charged to a prescribed potential V0 (V) by the charger 102. When the exposure section 13 radiates laser light to a prescribed area of the first area EA after the surface of the photosensitive drum is charged to the prescribed potential V0 (V), the electrostatic latent image GA is formed in the first area EA of the photosensitive drum 101, and the potential of the electrostatic latent image GA changes from the potential V0 to a potential VL (V).

By contrast, the development bias of the surface of the development roller 112 is a potential Vdc. The potential difference between the potential VL and the potential Vdc is a potential difference which moves charged toner particles TN from the development roller 112 to the electrostatic latent image GA. Specifically, the toner particles TN carried by the development roller 112 are electrically drawn and fly toward the electrostatic latent image GA of the photosensitive drum 101. As a result, the toner image TI is formed in the electrostatic latent image GA of the photosensitive drum 101.

Continuing, the image forming apparatus 100 is described in detail with reference to FIG. 2. As illustrated in FIG. 2, the image forming apparatus 100 further includes an electric current detector 22 and storage 80.

The electric current detector 22 detects the electric current value of the electric current flowing between the photosensitive drum 101 and the development roller 112. The electric current detector 22 then outputs a signal SG2 to the controller 20. The signal SG2 indicates the electric current value of the electric current flowing between the photosensitive drum 101 and the development roller 112.

Figure 6:
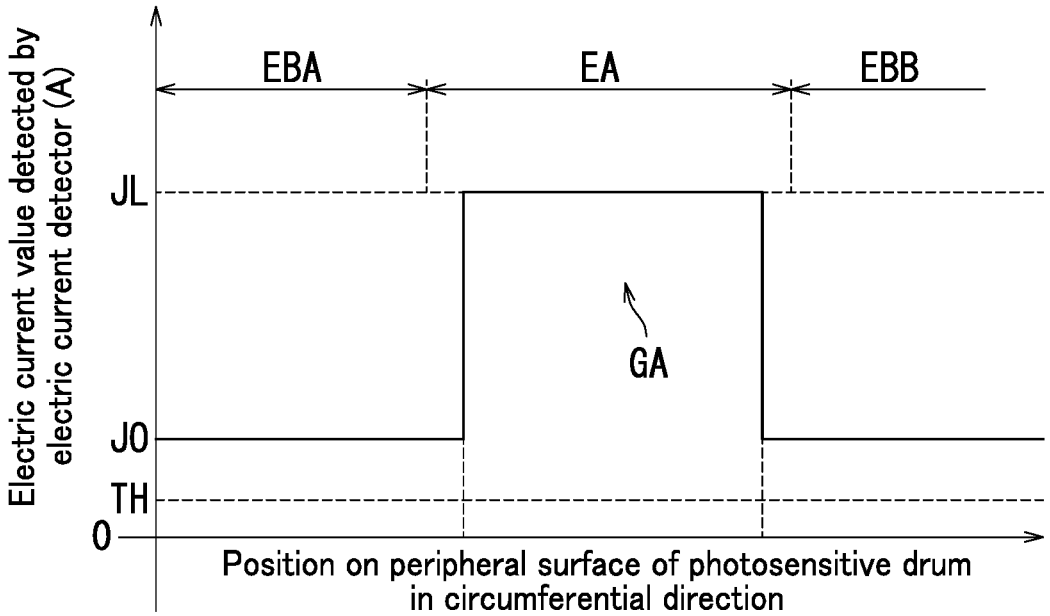
FIG. 6 is a graph illustrating an electric current value detected by an electric current detector according to the first embodiment.

The electric current value detected by the electric current detector 22 is described with reference to FIG. 6. FIG. 6 is a graph illustrating the electric current value detected by the electric current detector 22. In FIG. 6, the vertical axis indicates the electric current value detected by the electric current detector 22, and the horizontal axis indicates a position on the peripheral surface of the photosensitive drum 101.

As illustrated in FIG. 6, the electric current detector 22 detects a first electric current value JL and a second electric current value J0. The first electric current value JL is the value of a first electric current flowing between the photosensitive drum 101 and the development roller 112 when the electrostatic latent image GA is being formed. In detail, the first electric current value JL is the value of a first electric current flowing when the development roller 112 is opposite to the first area EA. For example, the first electric current value JL is large as a result of the positively charged toner particles TN flying from the development roller 112 to the photosensitive drum 101.

By contrast, the second electric current value J0 is the value of a second electric current flowing between the photosensitive drum 101 and the development roller 112 when the electrostatic latent image GA is not being formed. In detail, the second electric current value J0 is the value of a second electric current flowing when the development roller 112 is opposite to the second area EBA or the second area EBB. Because the toner particles TN do not fly to the photosensitive drum 101 from the development roller 112, the second electric current value J0 is small.

As illustrated in FIG. 2, the storage 80 includes a storage device and stores a reference value TH and a computer program therein. Specifically, the storage 80 includes a main storage device such as semiconductor memory and an auxiliary storage device such as either or both of semiconductor memory and a hard disk drive.

The reference value TH is an electric current value of a reference electric current flowing between the photosensitive drum 101 and the development roller 112 when the electrostatic latent image GA is not being formed, and is an electric current value detected by the electric current detector 22 after adjustment to at least one of the photosensitive drum 101 and the developing section 110. Specifically, the reference value TH is an electric current value of the electric current flowing when the development roller 112 is opposite to the second area EBA or the second area EBB, and is an electric current value detected in the state of the image forming section 11 after adjustment.

As a result, if the toner particles TN do not fly to the photosensitive drum 101 from the development roller 112 such as during adjustment, the second electric current value J0 is the reference value TH. By contrast, as illustrated in FIG. 6, when toner fogging or scattering of the toner particles TN occurs after the passage of several days and a prescribed number of toner particles TN fly from the development roller 112 to the photosensitive drum 101, the second electric current value J0 becomes larger than the reference value TH.

As illustrated in FIG. 2, the controller 20 includes a bias controller 20*a*, a drive controller 20*b*, a calculating section 20*c*, and an evaluating section 20*d*. Specifically, the controller 20 includes a processor such as a central processing unit (CPU). The processor of the controller 20 functions as the bias controller 20*a*, the drive controller 20*b*, the calculating section 20*c*, and the evaluating section 20*d* by executing the computer program stored in the storage device of the storage 80.

The bias controller 20*a* controls the voltage applicator 21 to assign the potential difference between the photosensitive drum 101 and the development roller 112. Specifically, the bias controller 20*a* controls the voltage applicator 21 such that the voltage applicator 21 applies a development bias to the development roller 112.

The drive controller 20*b* controls the drive section 23 to rotationally drive the photosensitive drum 101, the development roller 112, the first screw feeder 113, and the second screw feeder 114. For example, the drive controller 20*b* controls the drive section 23 such that the photosensitive drum 101 rotates at a prescribed linear speed. The linear speed indicates the speed of the peripheral surface of the photosensitive drum 101 in a tangent direction.

The calculating section 20*c* calculates a toner charge-to-mass ratio QPM based on an amount M of toner which forms the toner image TI and the first electric current value JL. Specifically, the calculating section 20*c* receives the signal SG1 from the density sensor 104. The signal SG1 indicates the density of the toner image transferred from the photosensitive drum 101 to the intermediate transfer belt 12*a*. The calculating section 20*c* then calculates the toner amount M of the toner forming the toner image TI based on the density of the toner image indicated by the signal SG1. The toner amount M indicates the mass of the toner forming the toner image.

Furthermore, the calculating section 20*c* receives the signal SG2 indicating the first electric current value JL from the electric current detector 22. The calculating section 20*c* then calculates a charge amount Q of the toner forming the toner image TI based on the first electric current value JL indicated by the signal SG2.

The calculating section 20*c* also calculates the toner charge-to-mass ratio QPM based on the toner amount M and the toner charge amount Q. Specifically, the toner charge-to-mass ratio QPM is expressed by QPM=Q/M. Accordingly, the toner charge-to-mass ratio QPM is a toner charge amount per unit of mass. Note that in a case where a toner amount M1 and a toner charge amount Q1 are calculated for a first toner image TI and a toner amount M2 and a toner charge amount Q2 are calculated for a second toner image TI, the toner charge-to-mass ratio QPM may be expressed by QPM=(Q1−Q2)/(M1−M2). The first toner image TI and the second toner image TI are toner images with mutually different toner masses M. The calculating section 20*c* may alternatively calculate the toner charge-to-mass ratio QPM based on the toner amount M of the toner forming the toner image TI, the first electric current value JL, and the second electric current value J0.

The evaluating section 20*d* evaluates the reliability of the calculation result of the toner charge-to-mass ratio QPM based on a result of comparison between the second electric current value J0 and the reference value TH. The reference value TH indicates an electric current value detected by the electric current detector 22 after adjustment to at least one of the photosensitive drum 101 and the developing section 110. By contrast, the second electric current value J0 indicates an electric current value detected by the electric current detector 22 during evaluation. In a case where the state of the image forming section 11 during evaluation is substantially identical to the state of the image forming section 11 after adjustment, the second electric current value J0 is substantially equal to the reference value TH. However, in a case where the state of the image forming section 11 during evaluation differs from the state of the image forming section 11 after adjustment, the second electric current value J0 differs from the reference value TH.

Therefore, according to the first embodiment, the evaluating section 20*d* can evaluate the reliability of the calculation result of the charge-to-mass ratio QPM calculated by the calculating section 20*c* based on a result of comparison between the second electric current value J0 and the reference value TH. For example, in a case where the difference between the second electric current value J0 and the reference value TH is large, the evaluating section 20*d* determines that performance is impaired in the state of the image forming section 11 during evaluation relative to the image forming section 11 after adjustment. Because performance is impaired in the state of the image forming section 11 during evaluation and toner fogging or scattering of the toner particles TN has occurred, the evaluating section 20*d* can evaluate the reliability of the calculation result of the charge-to-mass ratio QPM calculated by the calculating section 20*c* to be low.

By contrast, in a case where the difference between the second electric current value J0 and the reference value TH is small, the evaluating section 20*d* determines that the state of the image forming section 11 during evaluation is substantially identical to the image forming section 11 after adjustment. As a result, the evaluating section 20*d* can evaluate the reliability of the calculation result of the charge-to-mass ratio QPM calculated by the calculating section 20*c* to be high. Therefore, according to the first embodiment, the user can understand the reliability of the calculation result of the charge-to-mass ratio QPM calculated by the calculating section 20*c*. In particular, the user can understand whether or not the calculation result of the charge-to-mass ratio QPM is correct.

Figure 7:
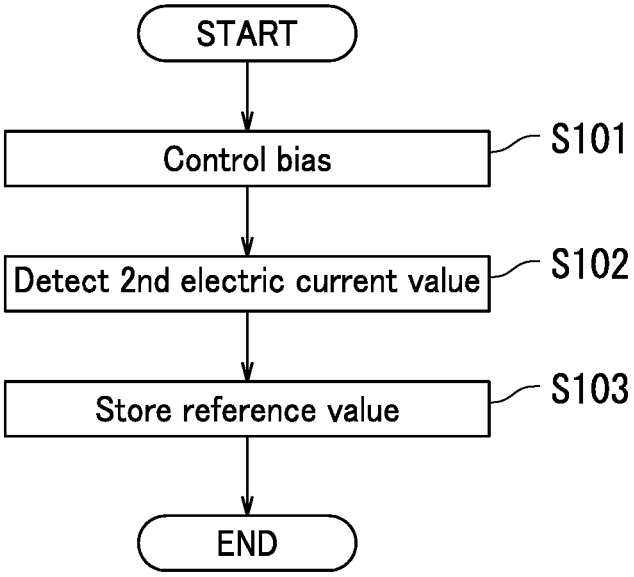
FIG. 7 is a flowchart depicting an example of a process performed by a controller according to the first embodiment.

Next, an example of a process performed by the controller 20 according to the first embodiment is described with reference to FIG. 7. FIG. 7 is a flowchart depicting the example of the process performed by the controller 20. The process performed by the controller 20 according to the first embodiment includes Steps S101 to S103. The process depicted in the flowchart of FIG. 7 is performed after adjustment to at least one of the photosensitive drum 101 and the developing section 110. Adjustment to at least one of the photosensitive drum 101 and the developing section 110 means, for example, at least one of a refreshing operation of the photosensitive drum 101, a refreshing operation of the developing section 110, replacement of the development roller 112, replacement of the photosensitive drum 101, and replacement of the carrier particles CA.

First, in Step S101, the bias controller 20*a* controls the voltage applicator 21 such that the voltage applicator 21 applies a development bias to the development roller 112. The process advances to Step S102.

Next, in Step S102, the electric current detector 22 detects the second electric current value J0. The process then advances to Step S103.

Finally, in Step S103, the storage 80 stores therein the second electric current value J0 as the reference value TH, and the process ends.

Figure 8:
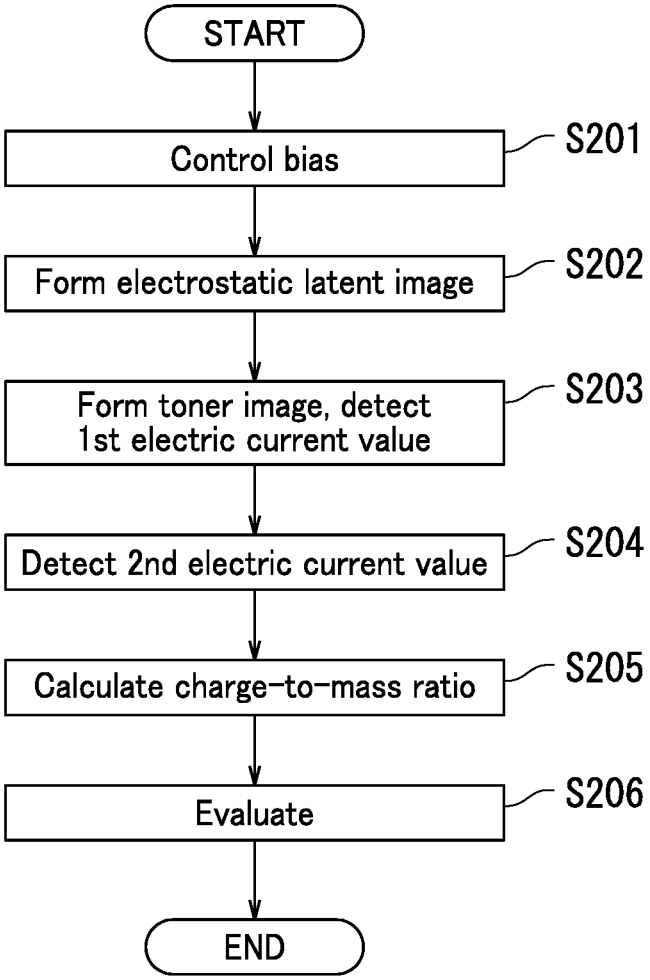
FIG. 8 is a flowchart depicting another example of a process performed by the controller according to the first embodiment.

Next, another example of a process performed by the controller 20 according to the first embodiment is described with reference to FIG. 8. FIG. 8 is a flowchart depicting the other example of the process performed by the controller 20. The process performed by the controller 20 according to the first embodiment includes Steps S201 to S206. The process depicted in the flowchart of FIG. 8 is performed during evaluation.

First, in Step S201, the bias controller 20*a* controls the voltage applicator 21 such that the voltage applicator 21 applies a development bias to the development roller 112. The process then advances to Step S202.

Next, in Step S202, the exposure section 13 radiates laser light to the first area EA to expose the first area EA, thus forming the electrostatic latent image GA in the first area EA. The process then advances to Step S203.

Next, in Step S203, the developing section 110 develops the electrostatic latent image GA formed on the photosensitive drum 101 with toner to form the toner image TI on the photosensitive drum 101. The electric current detector 22 detects the first electric current value JL. The process then advances to Step S204.

Next, in Step S204, the electric current detector 22 detects the second electric current value J0. The process then advances to Step S205.

Next, in Step S205, the calculating section 20*c* calculates the toner charge-to-mass ratio QPM based on the toner amount M of the toner forming the toner image TI and the first electric current value JL. The process then advances to Step S206.

Finally, in Step S206, the evaluating section 20*d* evaluates the reliability of the calculation result of the toner charge-to-mass ratio QPM based on a result of comparison between the second electric current value J0 and the reference value TH, and the process ends.

Second Embodiment

Figure 9:
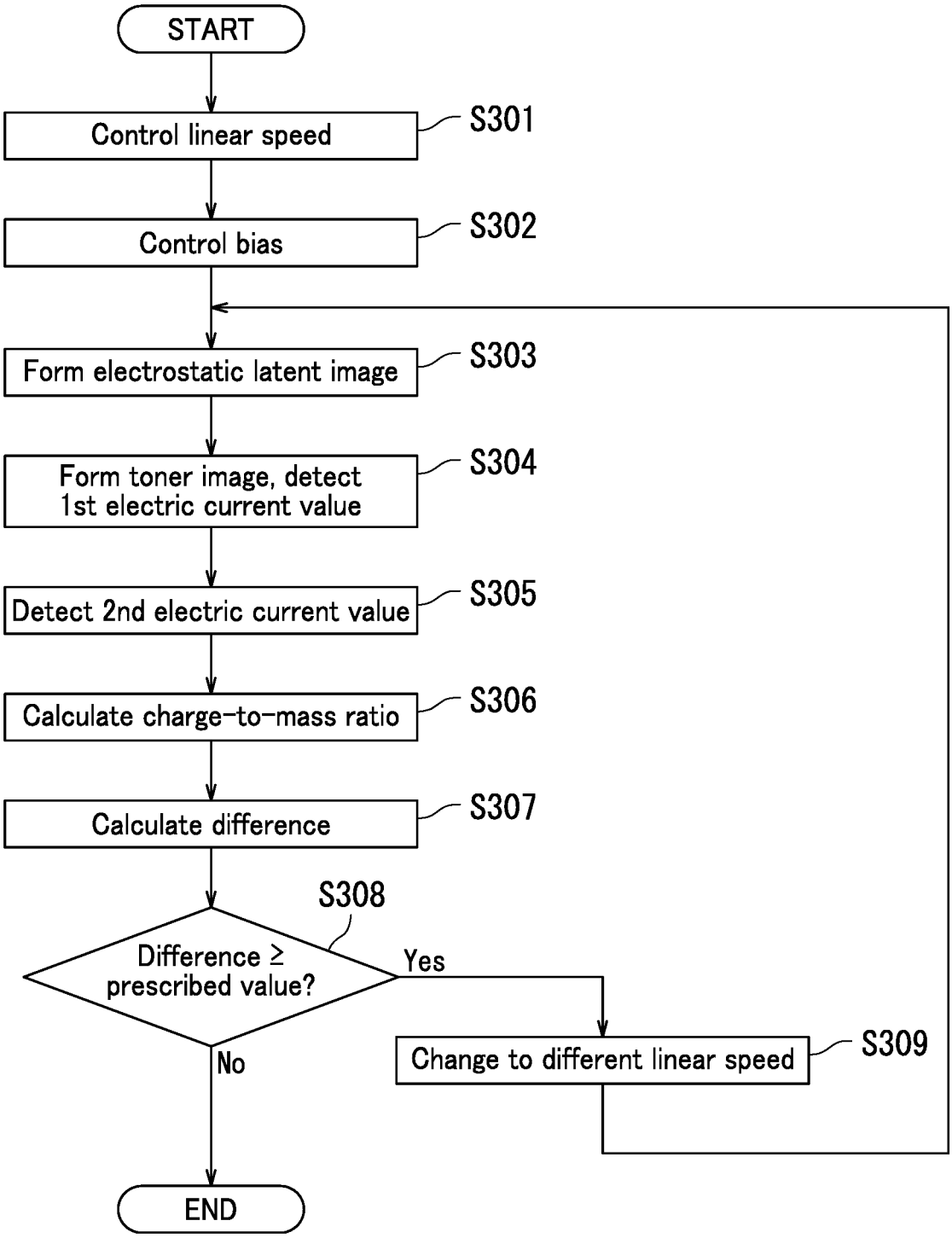
FIG. 9 is a flowchart depicting an example of a process performed by the controller according to a second embodiment.

The following describes the image forming apparatus 100 according to a second embodiment with reference to FIG. 9. The second embodiment differs from the first embodiment in that the storage 80 stores a plurality of reference values TH and a prescribed value therein.

The drive controller 20*b* controls the drive section 23 to rotationally drive the photosensitive drum 101, the development roller 112, the first screw feeder 113, and the second screw feeder 114. For example, the drive controller 20*b* controls the drive section 23 such that the linear speed of the peripheral surface of the photosensitive drum 101 in the tangent direction is a plurality of linear speeds. The linear speeds are mutually different.

The storage 80 stores the reference values TH therein. The reference values TH respectively correspond to the mutually different linear speeds. Each of the reference values TH is an electric current value of a reference electric current flowing between the photosensitive drum 101 and the development roller 112 when the electrostatic latent image GA is not being formed, and indicates an electric current value detected by the electric current detector 22 after adjustment to at least one of the photosensitive drum 101 and the developing section 110.

The storage 80 also stores a prescribed value therein. The prescribed value is a value for determining whether or not the state of the image forming section 11 during evaluation differs from the state of the image forming section 11 after adjustment. For example, the evaluating section 20*d* calculates the difference between the second electric current value J0 and a reference value TH. When the difference between the second electric current value J0 and the reference value TH is equal to or greater than the prescribed value, the evaluating section 20*d* determines that the state of the image forming section 11 during evaluation differs from the state of the image forming section 11 after adjustment. By contrast, when the difference between the second electric current value J0 and the reference value TH is less than the prescribed value, the evaluating section 20*d* determines that the state of the image forming section 11 during evaluation is substantially identical to the state of the image forming section 11 after adjustment. That is, the evaluating section 20*d* evaluates the state of the image forming section 11 during evaluation according to whether or not the difference between the second electric current value J0 and the reference value TH is equal to or greater than the prescribed value.

The evaluating section 20*d* evaluates the reliability of the calculation result according to whether or not the difference between the second electric current value J0 and the reference value TH is equal to or greater than the prescribed value. Specifically, when the difference between the second electric current value J0 and the reference value TH is less than the prescribed value, the evaluating section 20*d* can evaluate the reliability of the calculation result of the charge-to-mass ratio QPM calculated by the calculating section 20*c* to be high because the state of the image forming section 11 during evaluation is substantially identical to the state of the image forming section 11 after adjustment. By contrast, when the difference between the second electric current value J0 is equal to or greater than the reference value TH, the evaluating section 20*d* can evaluate the reliability of the calculation result of the charge-to-mass ratio QPM calculated by the calculating section 20*c* to be low because the state of the image forming section 11 during evaluation differs from the state of the image forming section 11 after adjustment.

When the difference between the second electric current value J0 detected at the prescribed linear speed and the reference value TH is equal to or greater than the prescribed value, the evaluating section 20*d* compares the second electric current value J0 detected at a linear speed differing from the prescribed linear speed to the reference value TH. For example, because the evaluating section 20*d* evaluates the reliability of the calculation result of the charge-to-mass ratio QPM to be low, the drive controller 20*b* controls the drive section 23 so as to drive at a linear speed differing from the prescribed linear speed. The electric current detector 22 detects the second electric current value J0 at a linear speed differing from the prescribed linear speed. The evaluating section 20*d* compares the second electric current value J0 detected at the linear speed differing from the prescribed linear speed to the reference value TH.

As a result, in a case where the difference between the second electric current value J0 detected at the linear speed differing from the prescribed linear speed and the reference value TH is also equal to or greater than the prescribed value for example, the user can understand that a highly reliable calculation result cannot be obtained when detecting at a different linear speed either. Therefore, the user performs adjustment to at least one of the photosensitive drum 101 and the developing section 110. By contrast, in a case where the difference between the second electric current value J0 detected at the linear speed differing from the prescribed linear speed and the reference value TH is equal to or greater than the prescribed value, the user can understand that a highly reliable calculation result can be obtained at the speed differing from the prescribed linear speed.

Next, an example of a process performed by the controller 20 according to the second embodiment is described with reference to FIG. 9. FIG. 9 is a flowchart depicting the example of the process performed by the controller 20. The process performed by the controller 20 according to the second embodiment includes Steps S301 to S309. Steps S302 to S306 in FIG. 9 are respectively the same as Steps S201 to S205 described above with reference to FIG. 8. Therefore, FIG. 9 differs from FIG. 8 due to the addition of Steps S301 and S307 to S309. To avoid redundancy, duplicate description is omitted.

First, in Step S301, the drive controller 20*b* controls the drive section 23 so as to drive at the prescribed linear speed. After the process has advanced through Steps S302 to S306, the process advances to Step S307.

Next, in Step S307, the evaluating section 20*d* calculates the difference between the second electric current value J0 and the reference value TH. The process then advances to Step S308.

Next, in Step S308, the evaluating section 20*d* determines whether or not the difference is equal to or greater than the prescribed value. When the evaluating section 20*d* has determined that the difference is equal to or greater than the prescribed value (YES in Step S308), the process advances to Step S309.

Next, in Step S309, the drive controller 20*b* controls the drive section 23 so as to drive at a linear speed differing from the prescribed linear speed. The process then returns to Step S303.

When a negative determination is made in Step S308 by contrast, the process ends.

Third Embodiment

Figure 10:
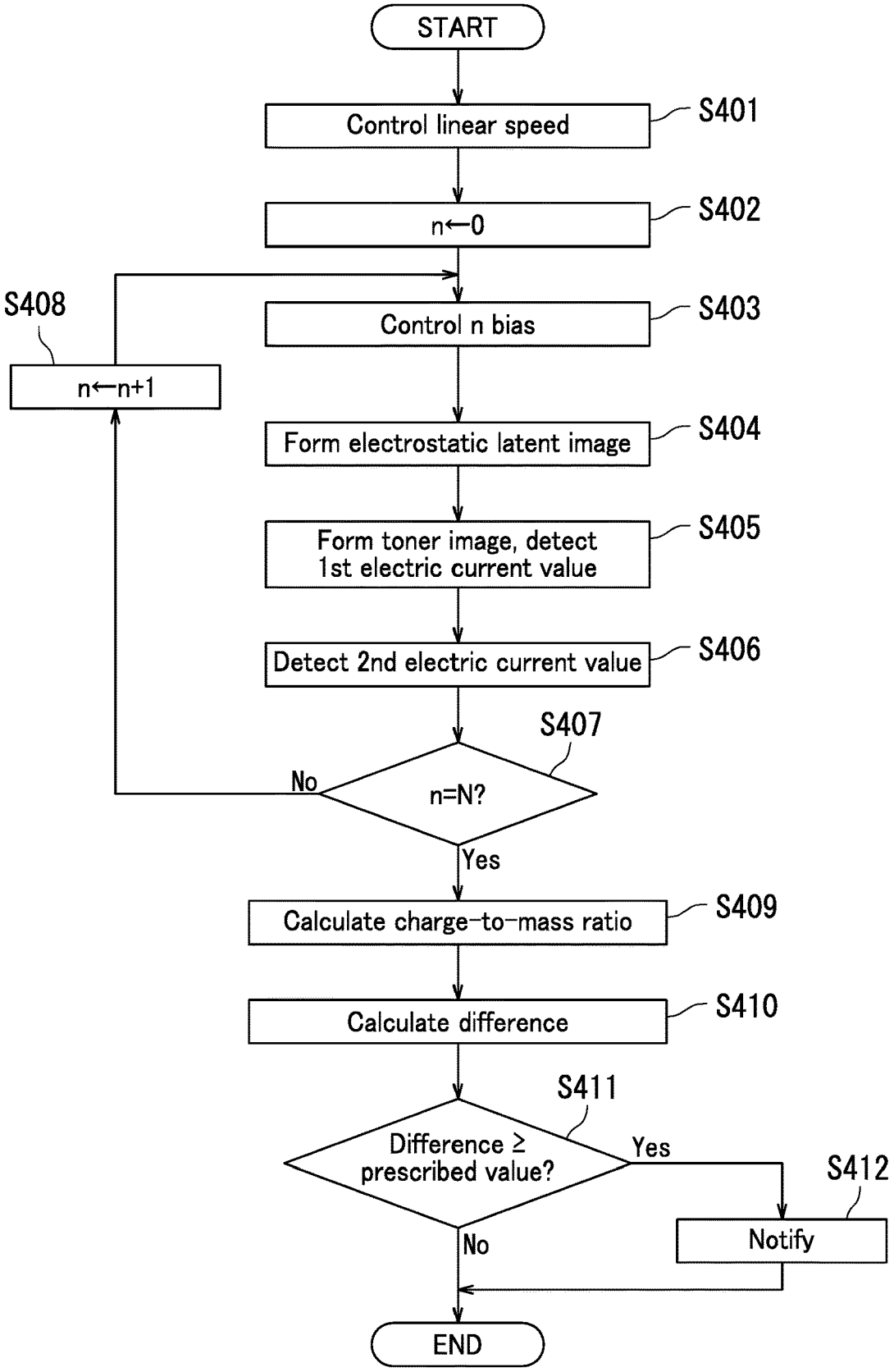
FIG. 10 is a flowchart depicting an example of a process performed by the controller according to a third embodiment.

The following describes the image forming apparatus 100 according to the third embodiment with reference to FIG. 10. The third embodiment differs from the second embodiment in that in calculating the charge-to-mass ratio QPM with the calculating section 20*c*, the voltage applicator 21 applies a plurality of development biases.

The storage 80 stores a reference value TH therein. The reference value TH indicates an amount of change between the electric current values of the reference electric currents relative to an amount of change between the voltage values of the development biases.

The bias controller 20*a* controls the voltage applicator 21 to provide a potential difference between the photosensitive drum 101 and the development roller 112. For example, in calculating the charge-to-mass ratio QPM with the calculating section 20*c*, the bias controller 20*a* controls the voltage applicator 21 such that the voltage applicator 21 applies the development biases to the development roller 112. The development biases are mutually different.

The electric current detector 22 detects the first electric current value JL and the second electric current value J0 for each development bias.

The calculating section 20*c* calculates information related to the toner charge-to-mass ratio QPM based on the toner amount M of the toner forming the toner image TI for each development bias and the first electric current value JL detected for each development bias.

The evaluating section 20*d* evaluates the reliability of the information related to the toner charge-to-mass ratio QPM based on a result of comparison between the amount of change between second electric current values J0 relative to the amount of change between the voltage values of the development biases and the reference value TH.

Therefore, according to the third embodiment, the reliability of the information related to the toner charge-to-mass ratio QPM can be evaluated on the basis that the amount of change between the second electric current values J0 relative to the amount of change between the voltage values of the development biases is compared to the reference value TH.

The controller 20 further includes a notifying section 20*e*. The notifying section 20*e* notifies of a change to a linear speed different from the prescribed linear speed among the linear speeds.

Therefore, according to the third embodiment, when the evaluating section 20*d* evaluates that the information related to the charge-to-mass ratio QPM detected at the prescribed linear speed is unreliable, the notifying section 20*e* notifies of a change to a linear speed differing from the prescribed linear speed. As a result, the user can understand that a calculation result is obtained at a linear speed differing from the prescribed linear speed.

Next, a process performed by the controller 20 according to the third embodiment is described with reference to FIG. 10. FIG. 10 is a flowchart depicting an example of the process performed by the controller 20. The process performed by the controller 20 according to the third embodiment includes Steps S401 to S412. Steps S404 to S406 in FIG. 10 are respectively the same as Steps S303 to S305 described above with reference to FIG. 9. Accordingly, FIG. 10 differs from FIG. 9 due to the addition of Steps S401 to S403 and S407 to S412. To avoid redundancy, duplicate description is omitted.

First, in Step S401, the drive controller 20*b* controls the drive section 23 so as to drive at the prescribed linear speed. The process then advances to Step S402.

Next, in Step S402, the bias controller 20*a* determines a type n of the development bias applied to the development roller 112 to be a type 0. The process then advances to Step S403.

Next, in Step S403, the bias controller 20*a* controls the voltage applicator 21 such that the voltage applicator 21 applies the nth development bias to the development roller 112. After the process has advanced through Steps S404 to S406, the process advances to Step S407.

Next, in Step S407, the bias controller 20*a* determines whether or not the type n is a type N. When the bias controller 20*a* has determined that the type n is not the type N (NO in Step S407), the process advances to Step S408.

Next, in Step S408, the bias controller 20*a* changes the type n of the development bias applied to the development roller 112 to a type (n+1). The process then returns to Step S403.

When the bias controller 20*a* has determined that the type n is the type N by contrast (YES in Step S407), the process advances to Step S409.

Next, in Step S409, the calculating section 20*c* calculates information related to the toner charge-to-mass ratio QPM based on the toner amount M of the toner forming the toner image TI for each development bias and the first electric current value JL detected for each development bias. The process then advances to Step S410.

Next, in Step S410, the evaluating section 20*d* calculates the difference between the amount of change between the second electric current values J0 relative to the voltage values of the development biases and the reference value TH. The process then advances to Step S411.

Next, in Step S411, the evaluating section 20*d* determines whether or not the difference is equal to or greater than the prescribed value. When the evaluating section 20*d* has determined that the difference is equal to or greater than the prescribed value (YES in Step S411), the process advances to Step S412.

Next, in Step S412, the notifying section 20*e* notifies of a change to a linear speed differing from the prescribed linear speed among the linear speeds. Then, when the process of Step S412 ends or a negative determination is made in Step 411, the process ends.

The embodiments of the present disclosure are described above with reference to the accompanying drawings. However, the present disclosure is not limited to the above embodiments and may be implemented in various manners within a scope not departing from the gist thereof. The drawings illustrate main elements of configuration schematically to facilitate understanding. Aspects of the elements of configuration illustrated in the drawings, such as thickness, length, and number may differ in practice for the sake of convenience for drawing preparation. Aspects of the elements of configuration described in the above embodiments such as shape and dimension are merely examples and not particular limitations. The elements of configuration may be variously altered within a scope not substantially departing from the configuration of the present disclosure.

(1) As described with reference to FIGS. 1 to 10, the image forming apparatus 100 in the embodiments of the present disclosure is a color multifunction peripheral. However, the present disclosure is not limited as such. The image forming apparatus need only form an image on a sheet P. The image forming apparatus may be a color printer, for example. For another example, the image forming apparatus may be a monochrome copier.

(2) As described with reference to FIGS. 1 to 10, the evaluating section 20*d* evaluates based on a result of comparison between the second electric current value J0 and the reference value TH. However, the evaluating section 20*d* may evaluate based on a result of comparison between a voltage value corresponding to the second electric current value J0 and the reference value TH.

Figure 11:
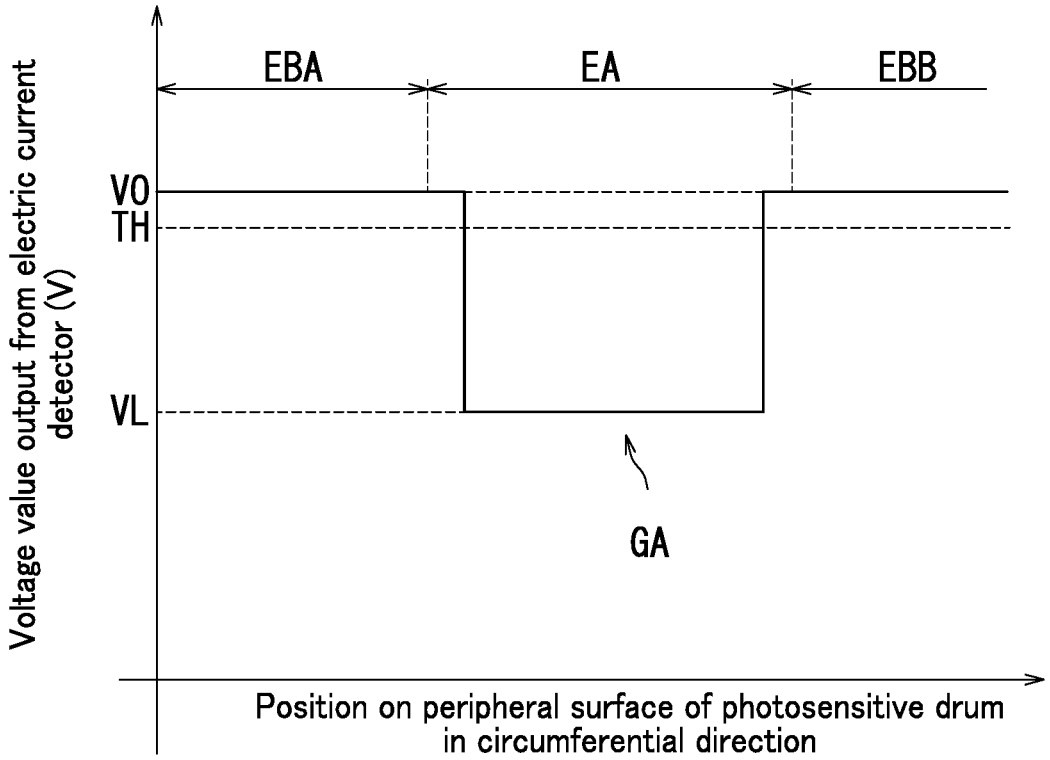
FIG. 11 is a graph illustrating a voltage value output from the electric current detector according to a variation of the present disclosure.

The following describes a voltage value output by the electric current detector 22 with reference to FIG. 11. FIG. 11 is a graph illustrating a voltage value output from the electric current detector 22. In FIG. 11, the vertical axis indicates the voltage value output from the electric current detector 22, and the horizontal axis indicates a position on the peripheral surface of the photosensitive drum 101 in the circumferential direction thereof. As illustrated in FIG. 11, the electric current detector 22 detects the value of the electric current flowing between the photosensitive drum 101 and the development roller 112. The electric current detector 22 then outputs a signal SG2 to the controller 20. The signal SG2 indicates the voltage value corresponding to the electric current flowing between the photosensitive drum 101 and the development roller 112. Specifically, the electric current detector 22 outputs a larger voltage value as the electric current value of the electric current flowing between the photosensitive drum 101 and the development roller 112 decreases.

Therefore, according to the present embodiment, the evaluating section 20*d* can evaluate the reliability of the calculation result of the charge-to-mass ratio QPM calculated by the calculating section 20*c* based on the result of comparison between the voltage value and the reference value TH.

What is claimed is:

1. An image forming apparatus comprising:

a photosensitive drum;

a developing section configured to develop an electrostatic latent image formed on the photosensitive drum with toner to form a toner image on the photosensitive drum;

a voltage applicator configured to apply a development bias to the developing section;

a detector configured to detect an electric current value of a first electric current and an electric current value of a second electric current, the first electric current flowing between the photosensitive drum and the developing section when the electrostatic latent image is being formed, the second electric current flowing between the photosensitive drum and the developing section when the electrostatic latent image is not being formed;

a calculating section configured to calculate a charge-to-mass ratio of the toner based on an amount of the toner forming the toner image and the electric current value of the first electric current; and an evaluating section configured to evaluate reliability of a calculation result of the charge-to-mass ratio of the toner based on a result of comparison between the electric current value of the second electric current and a reference value, wherein the reference value is an electric current value of a reference electric current flowing between the photosensitive drum and the developing section when the electrostatic latent image is not being formed, and indicates the electric current value detected by the detector after adjustment to at least one of the photosensitive drum and the developing section.

2. The image forming apparatus according to claim 1, wherein the calculating section calculates the charge-to-mass ratio of the toner based on the amount of the toner forming the toner image, the electric current value of the first electric current, and the electric current value of the second electric current, and the evaluating section evaluates the reliability of the calculation result of the charge-to-mass ratio of the toner based on a result of comparison between the electric current value of the second electric current and the reference value.

3. The image forming apparatus according to claim 2, wherein the evaluating section evaluates the reliability of the calculation result according to whether or not a difference between the electric current value of the second electric current and the reference value is equal to or greater than a prescribed value.

4. The image forming apparatus according to claim 3, further comprising storage which stores therein, as the reference value, a plurality of reference values respectively corresponding to a plurality of mutually differing linear speeds, wherein the detector detects the electric current value of the second electric current at a prescribed linear speed among the linear speeds, when the evaluating section determines that the difference between the electric current value of the second electric current and a reference value of the reference values corresponding to the prescribed linear speed is equal to or greater than the prescribed value, the detector detects the electric current value of the second electric current at a linear speed differing from the prescribed linear speed among the linear speeds, and the evaluating section compares the electric current value of the second electric current to a reference value of the reference values corresponding to the linear speed differing from the prescribed linear speed among the linear speeds.

5. The image forming apparatus according to claim 3, further comprising:

storage which stores therein, as the reference value, a plurality of reference values respectively corresponding to a plurality of mutually differing linear speeds; and a notifying section, wherein the detector detects the electric current value of the second electric current at a prescribed linear speed among the linear speeds, and when the evaluating section determines that the difference between the electric current value of the second electric current and a reference value of the reference values corresponding to the prescribed linear speed is equal to or greater than the prescribed value, the notifying section notifies of a change to a linear speed differing from the prescribed linear speed among the linear speeds.

6. The image forming apparatus according to claim 1, wherein the voltage applicator applies, as the development bias, a plurality of development biases, the development biases differing from each other, the detector detects an electric current value of the second electric current at each of the development biases, and the evaluating section evaluates the reliability of the calculation result of the charge-to-mass ratio of the toner based on a result of comparison between an amount of change between electric current values of the second electric current relative to an amount of change between voltage values of the development biases and the reference value.

* * * * *